US007497040B2

(12) United States Patent
Chambless

(10) Patent No.: US 7,497,040 B2
(45) Date of Patent: Mar. 3, 2009

(54) ILLUMINATED HANDHELD TRAFFIC SIGN

(76) Inventor: Wyman E. Chambless, 6901 Wooddale Dr., Watauga, TX (US) 76148

( * ) Notice: Subject to any disclaimer, the term of this patent is extended or adjusted under 35 U.S.C. 154(b) by 0 days.

(21) Appl. No.: 11/266,045

(22) Filed: Nov. 3, 2005

(65) Prior Publication Data

US 2007/0113445 A1 May 24, 2007

(51) Int. Cl.
*G08B 5/00* (2006.01)

(52) U.S. Cl. ..... 40/586; 40/550

(58) Field of Classification Search ..... 40/586, 40/607.11, 607, 12, 550, 546
See application file for complete search history.

(56) References Cited

U.S. PATENT DOCUMENTS

| | | | | |
|---|---|---|---|---|
| 5,440,464 | A * | 8/1995 | Nowlin et al. | 362/190 |
| 6,009,650 | A * | 1/2000 | Lamparter | 40/572 |
| 6,035,567 | A * | 3/2000 | Cameron | 40/607.04 |
| 6,198,410 | B1 * | 3/2001 | White et al. | 340/907 |
| 6,204,777 | B1 | 3/2001 | Lyons | 340/908 |
| 6,796,062 | B1 | 9/2004 | deKoevend | 40/586 |
| 2004/0003523 | A1 | 1/2004 | Spencer | 40/452 |
| 2004/0062032 | A1 * | 4/2004 | Mass | 362/84 |
| 2006/0012486 | A1 * | 1/2006 | Gibson et al. | 340/815.45 |

FOREIGN PATENT DOCUMENTS

CA 2344039 A1 * 10/2002

* cited by examiner

*Primary Examiner*—Cassandra Davis
(74) *Attorney, Agent, or Firm*—Michael Diaz

(57) ABSTRACT

A handheld illuminated traffic sign is disclosed. The handheld sign provides a warning to oncoming traffic. The sign includes a planar surface having two sides. Each side includes a solid background color having a plurality of block letters providing a warning. The block letters are illuminated by red LED bulbs. The sign also includes a perimeter which is illuminated by a plurality of side mounted bulbs. A printed circuit board is located in an interior portion of the sign. The sign also includes a handle. The red LED bulbs may be flashing. The sign may include a blue beacon mounted on a top portion of the sign or a line of blue lights outlining the perimeter of the sign. The handle may be extendable to lengthen the handle.

17 Claims, 5 Drawing Sheets

ILLUMINATED HANDHELD TRAFFIC SIGN

BACKGROUND OF THE INVENTION

1. Field of the Invention

This invention relates to safety devices. Specifically, and not by way of limitation, the present invention relates to an illuminated cautionary handheld traffic sign.

2. Description of the Related Art

Across the nation, there are countless schools manned by individuals whose sole task is the safe passage of children across a street crossing in the vicinity of schools. There have been various laws enacted to ensure the safety of these children. For example, a stringent reduced speed limit is strictly enforced around school zones. Additionally, as stated above, most busy crosswalks are manned by an adult with a stop sign. When children cross a crosswalk, the adult carrying the sign walks out into the center of the street with the raised sign. However, because of the very nature of children, there are still many accidents involving vehicles hitting children around crosswalk areas. Oftentimes, the children are at fault. However, it is incumbent upon the drivers to exercise extreme caution around these crosswalks. However, for various reasons, at times drivers are unaware of the crosswalks. Even with adults carrying stop signs raised high above their heads, drivers still run the crosswalks. Additionally, at some times during the year and during inclement weather, children travel to and from school in the dark. Thus, a stop sign having no illumination is often not sufficient to alert drivers. A device is needed which provides enhanced illumination to alert the driver to even a greater degree than is present in existing signs.

Handheld traffic signs are also used in other circumstances. During road construction, it is common for a worker to hold a sign to warn of upcoming road construction. The construction often necessitates a reduced speed by vehicles. Rather than holding the signs for a few minutes in the morning and afternoon, the workers often have to hold the signs for several hours. Again, drivers sometimes miss the warning provided by these signs which are not illuminated.

Although there are no known prior art teachings of a solution to the aforementioned deficiency and shortcoming such as that disclosed herein, prior art references that discuss subject matter that bears some relation to matters discussed herein are U.S. Patent Application Publication No. 2004/0003523 to Spencer (Spencer), U.S. Pat. No. 6,204,777 to Lyons (Lyons), and U.S. Pat. No. 6,796,062 to deKoevend (deKoevend).

Spencer discloses a hand-held signaling device having an illuminated display capable of selectively displaying illuminated indicia including words such as "stop" and "go." Spencer does not teach or suggest a device which is easy to carry for a long period of time. Spencer does not disclose an elongated handle or pole. Additionally, Spencer does not teach or suggest a lighting scheme to catch the attention of a driver. Spencer is merely a handheld programmable textual sign.

Lyons discloses a sign having an LED array attached to a pole with a battery mounted on a bottom end of the pole. Although Lyons discloses the use of an LED array, the lighting scheme disclosed in Lyons does not provide sufficient attention to drivers. Lyons does not teach or suggest perimeter light to accentuate the perimeter and outer edges of the background of the sign. Additionally, because of the location of the battery, the pole may not be separated from the sign, thereby making it extremely difficult to transport in small areas, such as trunks of automobiles.

deKoevend discloses a traffic sign having an elongated pole. The sign is biased to automatically rotate about the pole.

However, deKoevend does not teach or suggest a LED lighting array which provides a lighting scheme to attract the attention of drivers.

None of the references provides a sufficiently effective lighting scheme to attract the attention of drivers in either day or night. Additionally, none of the references provides a sufficiently transportable handheld sign with various lengths of the pole. Thus, it would be a distinct advantage to have a fully transportable handheld sign which provides a lighting scheme which more effectively provides warning to drivers of upcoming hazards or cautionary zones. It is an object of the present invention to provide such an apparatus.

SUMMARY OF THE INVENTION

In one aspect, the present invention is a handheld sign providing a warning to oncoming traffic. The sign includes a planar surface having a first planar surface and an opposing second planar surface. Each surface has a message to provide a warning to the oncoming traffic. The sign also includes a handle attached to the planar surface. The message includes block letters illuminated by a plurality of bulbs. The planar surface also has a perimeter which is illuminated by a perimeter illumination system. A control board mounted within the interior of the planar surface is used to energize the plurality of bulbs and the perimeter illumination system. A power source mounted within the handle is used to power the control board, the plurality of bulbs and the perimeter illumination system.

In another aspect, the present invention is a handheld sign providing a warning to oncoming traffic. The sign includes a planar surface having a first planar surface and an opposing second planar surface. Each surface has a solid color background and indicia to provide a warning to the oncoming traffic. A handle is attached to the planar surface. The indicia are a plurality of white block letters. Each letter has a plurality of red LED bulbs to illuminate the block letter. The planar surface has a perimeter with a channel piece mounted to the perimeter. The channel piece has a plurality of side bulbs facing an interior portion of the planar surface to illuminate the perimeter. A control board is mounted between the first planar surface and the second planar surface to energize the plurality of bulbs and the plurality of side bulbs. The sign also includes a power source mounted within the handle to power the control board, the plurality of bulbs and the plurality of side bulbs.

In still another aspect, the present invention is a handheld sign providing a warning. The planar surface has two planar surfaces. Each surface has a solid color background and indicia to provide a warning. An elongated handle is attached to the planar surface. The indicia are a plurality of block letters. Each letter has a plurality of red LED bulbs to illuminate the block letter. The planar surface also has a blue beacon mounted to a top portion of the planar surface. The beacon provides outward illumination from the first planar surface and the second planar surface. A control board energizes the plurality of bulbs and the beacon. A rechargeable power source is used to power the control board, the plurality of bulbs and the beacon.

BRIEF DESCRIPTION OF THE DRAWINGS

The invention will be better understood and its numerous objects and advantages will become more apparent to those skilled in the art by reference to the following drawings, in conjunction with the accompanying specification, in which.

DESCRIPTION OF THE INVENTION

Figure 1:
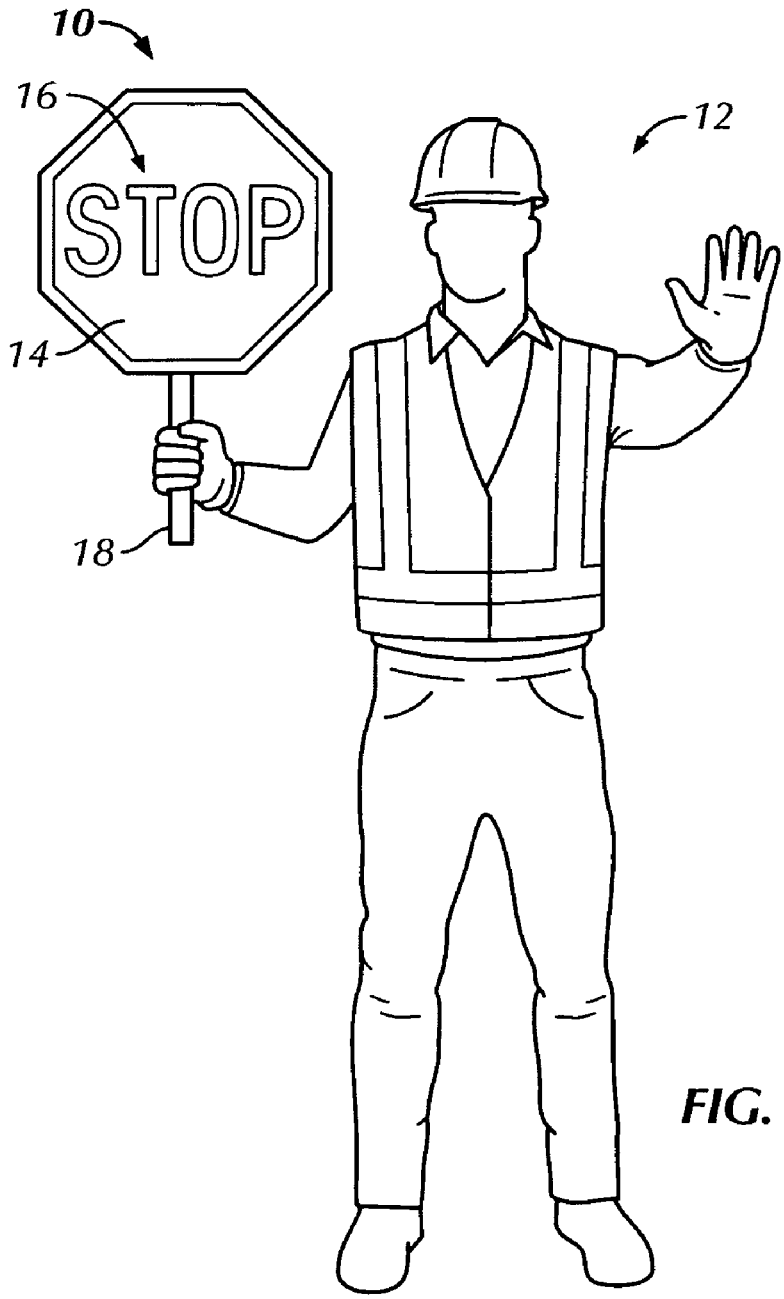
FIG. 1 is a front perspective view of a handheld sign held by a crossing guard in the preferred embodiment of the present invention.

An illuminated handheld sign is disclosed. FIG. 1 is a front perspective view of a handheld sign 10 held by a crossing guard 12 in the preferred embodiment of the present invention. The handheld sign includes a planar surface 14 sized to provide a textual or symbolic message 16 readable by individuals from a distance. Preferably, to conform to traffic road sign regulations, the sign is octagonally shaped. The handheld sign includes a handle 18. The handle is preferably long enough for an individual to raise the sign above his head. The planar surface is preferably constructed of a rigid material, such as a steel or plastic.

Figure 2:
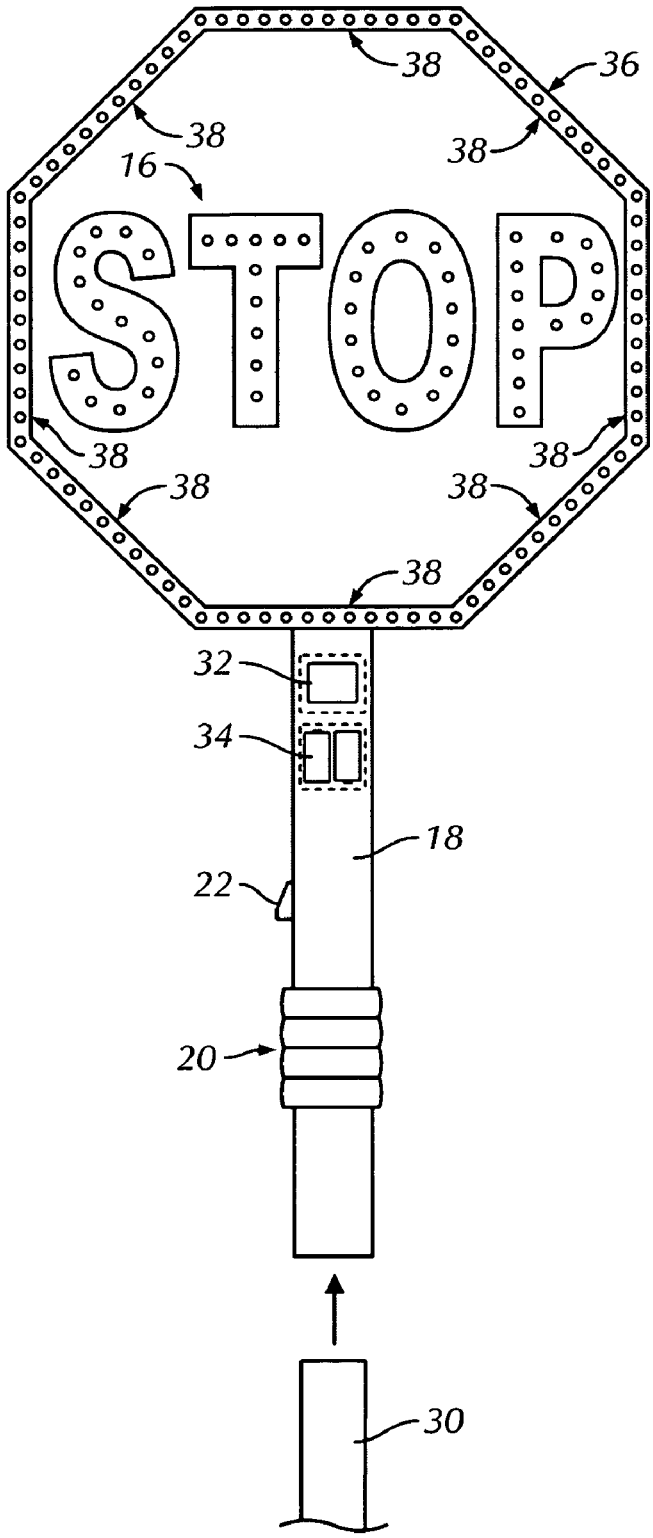
FIG. 2 is a front view of the handheld sign of FIG. 1.

FIG. 2 is a front view of the handheld sign 10. The sign 10 may include a handhold 20 which is contoured to provide placement of the user's hands on the handle 18. Additionally, the handle may include a trigger switch 22 for activation of the illumination of the sign. The handle may be optionally attachable to a separate elongated section or sections 30 to allow an extended length to the handle 18. With a sufficiently long extension, the sign may be allowed to rest upon the ground while still providing an elevated position of the planar surface and message 16. In an alternate embodiment of the present invention, the handle may include a mountable telescopic section 30 which extends downward from a hollow portion of the handle or extension section. Additionally, the handle may be optionally detachable from the sign. The handle may also optionally be retractable into itself, thereby providing a shorter or longer length to the handle. It should be understood that any extension device may be used to lengthen the handle. In the preferred embodiment of the present invention, the sign includes a synchronizer 32 and a power source 34 (such as batteries, either rechargeable or conventional disposable) positioned within the handle 18. However, the power source and synchronizer may be located anywhere, such as within an interior portion of the planar surface. The sign is bordered by a perimeter 36 providing perimeter illumination 38. The planar surface includes two sides, whereby each side may include different messages (e.g., "slow" and "stop").

Figure 3:
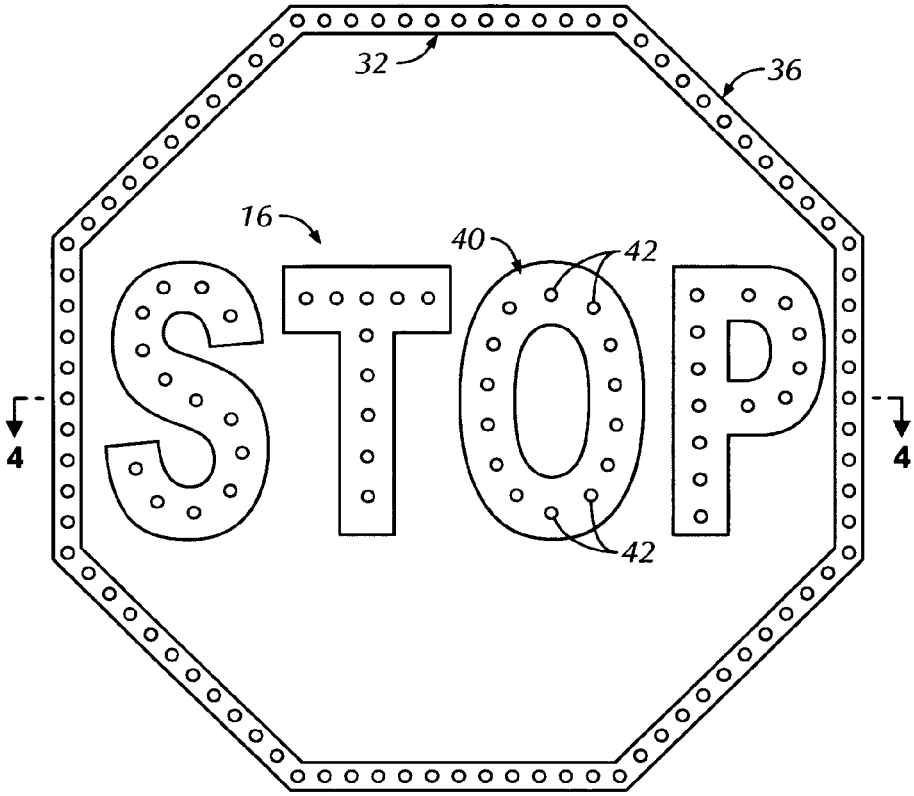
FIG. 3 is an enlarged front view of the planar surface of the handheld sign of FIG. 1.

FIG. 3 is an enlarged front view of the planar surface 14 of the handle sign 10. The planar surface includes the message 16. In the preferred embodiment of the present invention, the message includes white textual symbols forming block symbols 40 (e.g., letters). A background 41 covers the remaining portion of the planar surface. In the preferred embodiment of the present invention, the background is a solid color such as red or amber as appropriate for the textual message 16. Within the interior of each letter is outlined (in the center of the block letter) an LED array 42 having a plurality of LED bulbs 46. Preferably, to provide enhanced attention to the sign and the textual message, the LED bulbs are red. LED bulbs are preferable because of the brightness provided by a very small bulb and the low power consumption necessary to illuminate the bulb. Additionally, the white block symbols with the red LED bulbs provide a very novel lighting scheme which is far easier for a driver to notice from a greater distance than existing illuminated signs. However, it should be understood to those skilled in the art that various lighting schemes and block symbol colors may be used and still remain within the scope of the present invention. Additionally, in an alternate embodiment of the present invention, other types of bulbs besides LED bulbs may be utilized.

Figure 4:
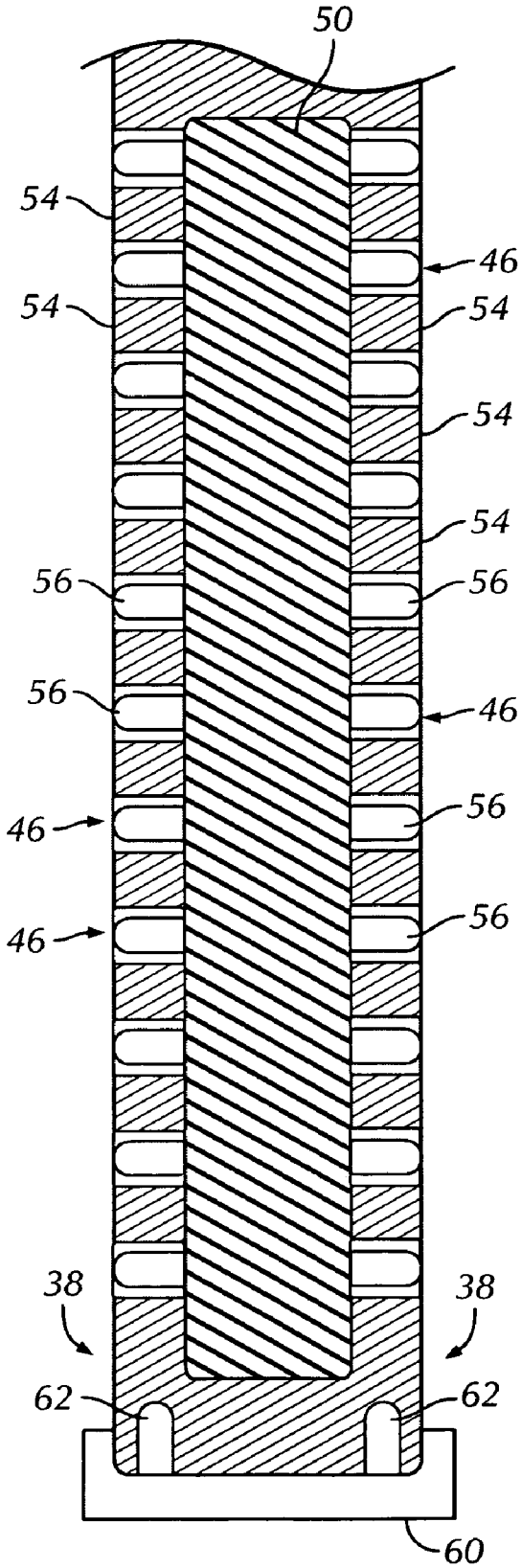
FIG. 4 is a cross section view of the handheld sign of FIG. 3.

FIG. 4 is a cross section view of the handheld sign 10 of FIG. 3 comprising the planar surface. The interior of the sign includes a printed circuit board 50 having a plurality of LED bulbs 46 mounted upon either side of the printed circuit board. A cover layer 54 having a plurality of recesses 56 to accommodate the positioning of the plurality of bulbs 46 within the recesses is overlaid the bulbs on each side of the sign. The cover layer 54 is preferably constructed of a red transparent rigid material, such as plexiglass.

The perimeter 36 includes a channel piece 60 for retaining the cover layer 54 and the printed circuit board 50 together. To provide the perimeter illumination 38 to the sign 38, the channel may include a perimeter illumination system. The perimeter illumination system include a plurality of bulbs 62 mounted inward toward the center of the sign at approximately a parallel or adjacent positioning with the planar surface 14 around the perimeter. The bulbs 62 are preferably mounted approximately abeam each cover layer within the channel piece. The perimeter illumination is particularly effective in outlining the shape of the sign. For example, it is quite common to associate a stop sign with an octagonal shape. Additionally, the perimeter illumination system illuminates a peripheral portion of the cover layer, and in the preferred embodiment of the present invention, the transparent cover layer glows red. The present invention provides a unique perimeter illumination to accentuate the outline of the sign as well as a portion of the background.

The printed circuit board controls the illumination of the bulbs 46. The printed circuit board is also connected to the synchronizer 32. The synchronizer 32 may provide flashing instructions to the printed circuit board to provide appropriate on/off instructions. In the preferred embodiment of the present invention, the red LED bulbs 46 flash on and off while the perimeter illumination 38 remains constantly on. Activation of the illumination may be by the trigger switch 22, which is connected to the synchronizer and the printed circuit board. Momentary depression of the trigger switch activates/energizes the sign while subsequent depression of the trigger switch de-energizes the sign.

With reference to FIGS. 1-4, the operation of the handheld sign 10 will now be explained. Because of the length and width of the handheld sign, the sign is easily transportable, such as in the trunk of an automobile. Preferably, the sing is an 18-24 inch octagon. The handle is preferably 8 to 9 inches in length. When desired, the user (crossing guard 12) may grasp the handle 18 at the handhold 20 which is contoured to receive the hand of the user. Preferably the power source 34 is a plurality of conventional disposal batteries which provide ample power for usage over a long period of time. The user then activates the sign by momentarily depressing the trigger switch 22. In an alternate embodiment of the present invention, the trigger switch may have to be depressed continuously to continually illuminate the sign. However, because the user may be tired of constantly depressing the trigger switch, it is preferred that activation is by momentary depression of the trigger switch.

Upon depressing the trigger switch 22, the power source 34 provides power to the synchronizer 32 and the printed circuit board 50. The printed circuit board and synchronizer provide lighting commands and energize the plurality of bulbs 46 and the bulbs 62. The red bulbs 46 are preferably illuminated in a sequenced flashing pattern to provide maximum attention to the sign and the textual message. Because the block symbols forms the letters of the textual message 16 and the red bulbs provide an interior outline of the letters, a unique lighting scheme providing maximum attention to the sign is obtained. Additionally, the bulbs located in the channel piece are illuminated inwardly toward a center portion of the planar surface, thereby providing perimeter illumination 38 and outlining the perimeter 36 of the sign and a peripheral portion of each cover layer. By outlining the perimeter of the sign, a driver may quickly determine the location of the sign and its general meaning (e.g., octagonal shape meaning caution/stop).

To assist the user in holding the sign, the handle may be extended by attaching a section or sections 30 to a bottom portion of the handle 18. The section may be attached in any fashion, such as by screwing a tapered collar end into a receiving end of the handle. In an alternate embodiment of the present invention, the handle may be telescopically extended to lengthen the handle.

When use of the sign is no longer needed, the section or sections may be removed or collapsed. Additionally, the trigger switch is depressed to de-energize the sign.

The handheld sign provides many advantages over existing signs. The handheld sign utilizes LED bulbs in such a fashion as to provide maximum illumination, while providing a small footprint and low energy consumption. The sign 20 also includes a unique lighting scheme which enhances the visibility of the sign by the driver. Specifically, by illuminating the white block symbols (e.g., letters) with red lights while outlining the perimeter to illuminate the perimeter and a portion of the background, a driver may more easily visually acquire the sign at a greater distance. Additionally, the signs are preferably constructed to comply with the Federal "Manual for Uniform Traffic Control Devices."

Figure 5:
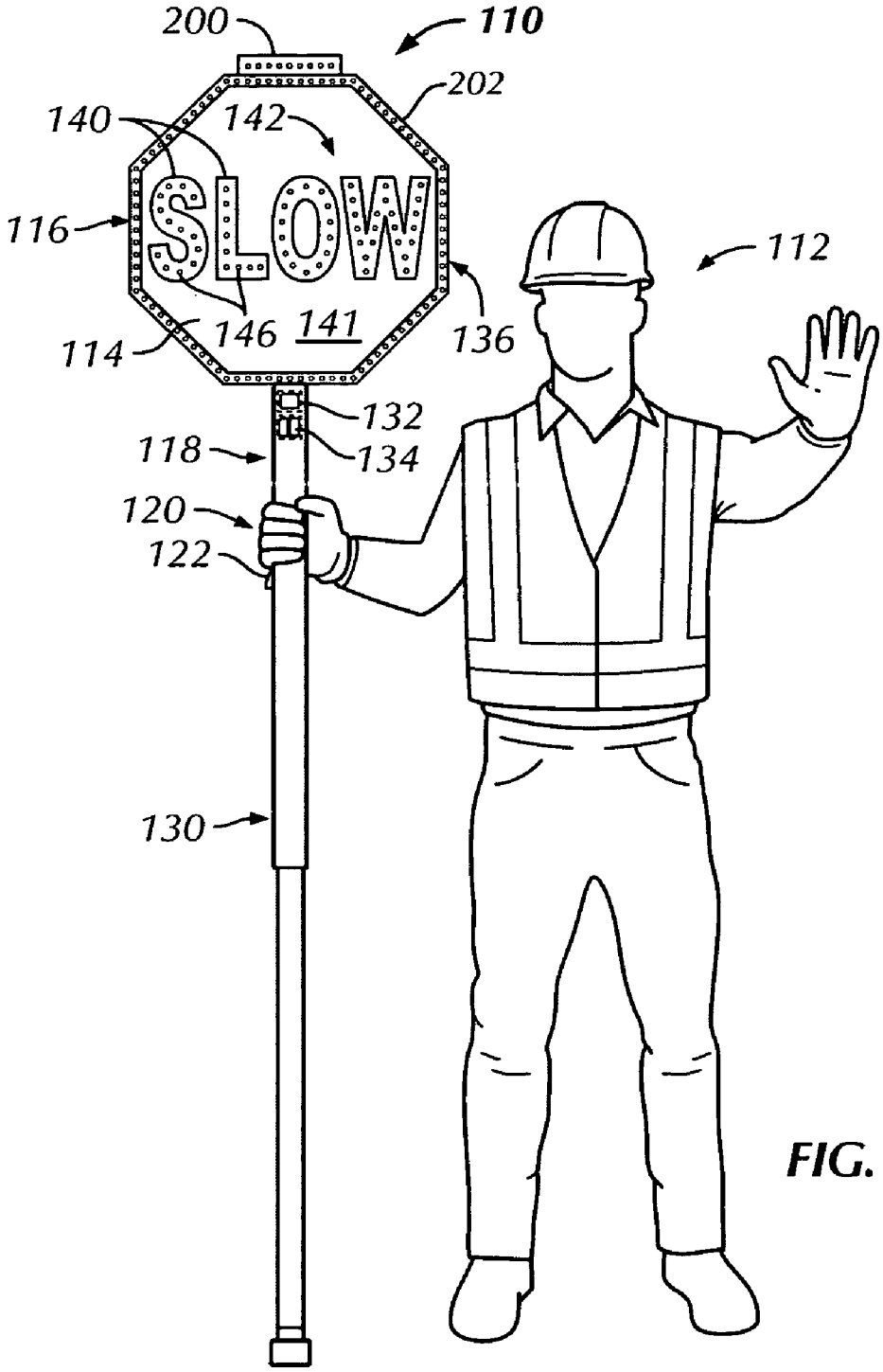
FIG. 5 is a front perspective view of a cautionary sign in an alternate embodiment of the present invention.

The handheld sign is particularly effective in school zones for use by crossing guards. However, there are other circumstances where a sign may be effectively used. For example, the present invention may be utilized at construction sites or areas where road construction is being conducted. FIG. 5 is a front perspective view of a cautionary sign 110 in an alternate embodiment of the present invention. The sign may be held by an individual 112. Preferably, the sign includes a planar surface 114 having a textual message 116. The planar surface is attached to an elongated handle 118 which may be several feet long. Alternately, the handle may be shorter with detachable sections 130. The sign 110 is similar to the sign 10 having a handhold 120, a trigger switch 122, a synchronizer 132 and a power source 134. Because of the heavy usage of the sign 110, the power source is preferably rechargeable batteries.

The planar surface 114 includes a perimeter 136, a background 141, and block symbols 140. Additionally, the block symbols are illuminated by an LED array 142 comprising a plurality of LED bulbs 146. The interior is constructed in a similar fashion as the sign 10 having a printed circuit board, cover layer with recesses. In this embodiment, the cover layer may be a rigid material and not necessarily transparent, such as a thin aluminum material. The block symbols are illuminated by the red LED bulbs. However, because the sign necessitates early acquisition by a driver from a greater distance than necessary for a school zone or on roadways where the speed limit is higher, additional lighting may be necessary. For example, the sign 110 may optionally include a beacon 200 mounted on a top position of the planar surface. Preferably, the beacon is blue to provide maximum attention by the driver upon the sign. It has been found that blue light provides a uniquely effective illumination which may be easily seen from great distances and in inclement weather. In addition, in an alternate embodiment of the present invention, the perimeter may be outlined by a line of blue LED bulbs 202. The bulbs face outwardly from the planar surface in the same manner as the red LED bulbs 146. However, the perimeter bulbs 202 are blue to provide the advantages of blue light to the outline of the sign. Additionally, the signs are preferably constructed to comply with the Federal "Manual for Uniform Traffic Control Devices."

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A handheld sign providing a warning, the handheld sign comprising:

a planar surface having a first planar surface and an opposing second planar surface, each surface having indicia to provide a warning;

a handle attached to the planar surface;

the indicia having at least one block symbol illuminated by a plurality of indicia bulbs;

the planar surface having a perimeter, the perimeter having an perimeter illumination system to illuminate the perimeter of the planar surface;

wherein the perimeter light system includes a channel piece located on the perimeter of the planar surface, the channel piece having a plurality of side bulbs facing an interior portion of the planar surface to illuminate the perimeter;

a control board to energize the plurality of bulbs and the perimeter illumination system, and the control board having a first side and a second side;

a first and second cover layer, each cover layer having a plurality of recesses to accommodate positioning of the plurality of bulbs within the recesses, the first cover layer being positioned over the first side of the control board and the second cover layer being positioned over the second side of the control board;

wherein the plurality of side bulbs are positioned abeam each cover layer; and a power source to power the control board, the plurality of bulbs and the perimeter illumination system.

2. The handheld sign of claim 1 wherein the handle has a trigger switch for activating the power source to provide power to the sign.

3. The handheld sign of claim 2 wherein the power source is activated upon momentary depression of the trigger switch.

4. The handheld sign of claim 1 wherein the handle includes a contoured grip for grasping by a user of the sign.

5. The handheld sign of claim 1 further comprising a synchronizer for flashing the plurality of bulbs.

6. The handheld sign of claim 1 wherein the plurality of indicia bulbs are red.

7. The handheld sign of claim 1 wherein the control board includes:

a first side and a second side, each side having the plurality of bulbs; and the plurality of bulbs illuminating indicia on the first surface and second surface of the planar surface.

8. The handheld sign of claim 7 wherein the perimeter includes a plurality of blue LED lights.

9. The handheld sign of claim 8 wherein the first and second cover layers are constructed of a red transparent material.

10. The handheld sign of claim 1 further comprising an elongated section attachable to a bottom portion of the handle.

11. The handheld sign of claim 1 wherein the handle includes a telescopically extendable section to lengthen the handle.

12. A handheld sign providing a warning, the handheld sign comprising:

a planar surface having a first planar surface and an opposing second planar surface, the first and second planar surfaces having a solid color background and indicia to provide a warning;

a handle attached to the planar surface;

the indicia having a plurality of white block letters, each letter having a plurality of red LED bulbs to illuminate the block letter;

the planar surface having a perimeter, the perimeter having a channel piece located on the perimeter of the planar surface, the channel piece having a plurality of side bulbs facing an interior portion of the planar surface to illuminate the perimeter;

a first cover layer and a second cover layer, the first cover layer overlaying the first planar surface and the second cover layer overlaying the second planar surface;

wherein the plurality of side bulbs are positioned abeam each cover layer;

a control board mounted between the first planar surface and the second planar surface to energize the plurality of bulbs and the plurality of side bulbs; and a power source mounted within the handle to power the control board, the plurality of bulbs and the plurality of side bulbs.

13. The handheld sign of claim 12 wherein the first and second cover layers each have a plurality of recesses to accommodate positioning of the plurality of bulbs within the recesses.

14. The handheld sign of claim 12 further comprising an elongated section attachable to a bottom portion of the handle.

15. A handheld sign providing a warning, the handheld sign comprising:

a planar surface having a first planar surface and an opposing second planar surface, each surface having a solid color background and indicia to provide a warning;

an elongated handle attached to the planar surface;

the indicia having a plurality of block letters, each letter having a plurality of red LED bulbs to illuminate the block letter;

the planar surface having a perimeter;

the perimeter having a channel piece located on the perimeter of the planar surface, the channel piece having a plurality of side bulbs facing an interior portion of the planar surface to iluminate the perimeter;

a first cover layer and a second cover layer, the first cover layer overlaying the first planar surface and the second cover layer overlaying the second planar surface;

wherein the plurality of side bulbs are positioned abeam each cover layer;

a beacon mounted to a top portion of the planar surface, the beacon providing outward illumination from the first planar surface and the second planar surface;

a control board to energize the plurality of bulbs and the beacon; and a power source to power the control board, the plurality of bulbs and the beacon.

16. The handheld sign of claim 15 wherein the beacon is a blue light.

17. The handheld sign of claim 15 further comprising a plurality of perimeter blue lights facing outwardly of the first planar surface and the second planar surface.

* * * * *